US005680944A

United States Patent [19]

Rueter

[11] Patent Number: 5,680,944

[45] Date of Patent: Oct. 28, 1997

[54] INSULATED OUTER LAYER FOR A THERMAL BOTTLE

[76] Inventor: John R. Rueter, 2720 Arrowhead, Springfield, Ill. 62702

[21] Appl. No.: 610,041

[22] Filed: Mar. 4, 1996

[51] Int. Cl.[6] ..... B65D 23/08; B65D 65/10; B65D 81/38

[52] U.S. Cl. ..... 215/13.1; 215/12.1; 150/154; 150/901; 220/739; 220/903

[58] Field of Search ..... 220/903, 739; 215/12.1, 13.1; 150/154, 901

[56] References Cited

U.S. PATENT DOCUMENTS

| | | | |
|---|---|---|---|
| 2,161,935 | 6/1939 | Roberts | 215/12.1 |
| 3,304,603 | 2/1967 | Piker | 215/13.1 X |
| 4,282,279 | 8/1981 | Strickland | 215/12.1 X |
| 4,344,303 | 8/1982 | Kelly, Jr. | 215/12.1 X |
| 4,399,668 | 8/1983 | Williamson | 215/12.1 X |
| 4,462,444 | 7/1984 | Larson | 220/903 X |
| 4,526,280 | 7/1985 | Taylor | 215/12.1 X |
| 4,986,089 | 1/1991 | Raab | 220/903 X |
| 5,109,588 | 5/1992 | Hewlett et al. | 220/903 X |
| 5,256,131 | 10/1993 | Owens et al. | 220/903 X |
| 5,320,249 | 6/1994 | Strech | 220/739 |

*Primary Examiner*—Sue A. Weaver

[57] ABSTRACT

Thermos bottle liner comprising a liner in a generally rectangular configuration and positionable in a cylindrical configuration around the side wall of the bottle, the liner including in a rectangular configuration with long upper and lower edges and short parallel side edges, an interior layer of a pile type fabric, preferably terry cloth, the liner also including an exterior layer fabricated of a flexible plastic in a rectangular configuration with long upper and lower edges and short parallel side edges, the interior layer and exterior layer being off set laterally with respect to each other forming an outwardly exteriorly facing rectangular coupling area on the exterior face of the interior layer with a pile type fastener thereon and forming an inwardly facing rectangular area on the interior face of the exterior layer with a pile type fastener.

1 Claim, 2 Drawing Sheets

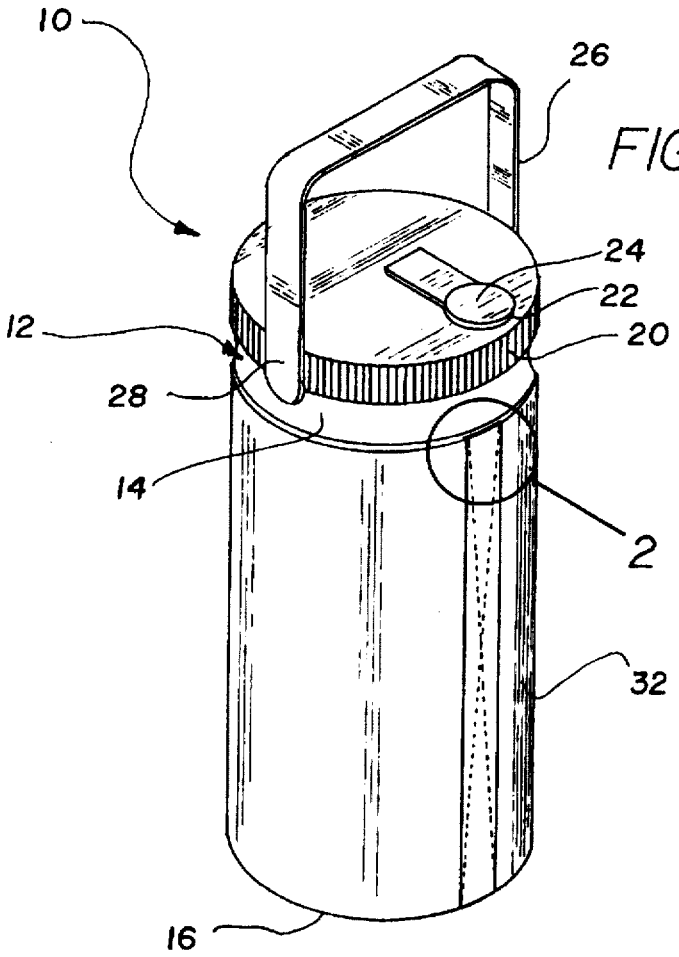
FIG. 1
FIG. 2
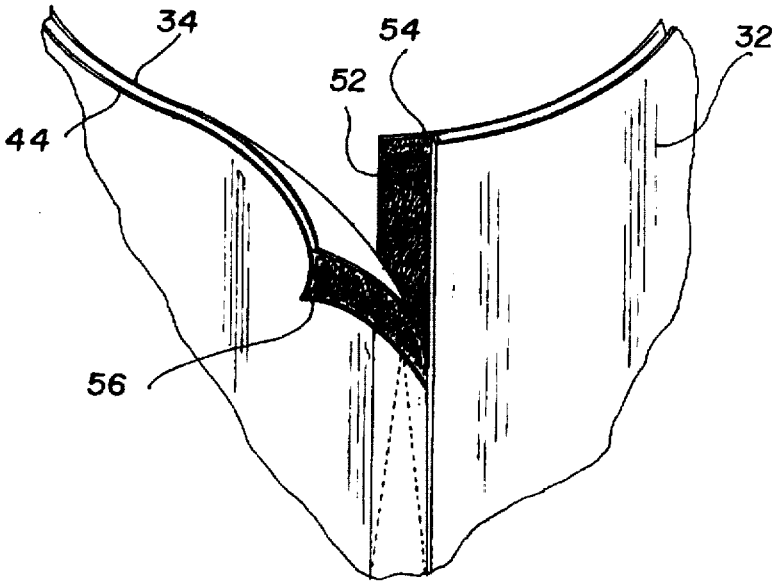

INSULATED OUTER LAYER FOR A THERMAL BOTTLE

BACKGROUND OF THE INVENTION

1. Field of the Invention

The present invention relates to thermos bottle liner system and more particularly pertains to maintaining a thermos bottle cool while providing the user with a towel that can be wetted to cool the body.

2. Description of the Prior Art

The use of Thermos bottles and wraps therefore is known in the prior art. More specifically, Thermos bottles and wraps heretofore devised and utilized for the purpose of maintaining Thermos bottles at a predetermined temperature while maximizing the efficiency thereof through various methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,184,626 to Graser et al. discloses an improved wrap-around beverage carrier which provides for total separation.

U.S. Pat. No. 4,438,843 to Graser discloses wrap-around style beverage bottle carrier with fully integrated product separation.

U.S. Pat. No. 4,986,089 to Raab discloses adjustable refrigeratable beverage wrap around holder.

U.S. Pat. No. 5,109,588 to Hewlett et al. discloses cooling wrap method of manufacture.

U.S. Pat. No. 5,256,131 to Owens et al. discloses beverage cooling or heating wrap method of manufacture.

In this respect, the Thermos bottle liner system according to the present invention substantially departs from the conventional concepts and designs of the prior art, and in doing so provides an apparatus primarily developed for the purpose of maintaining a Thermos bottle cool while providing the user with a towel that can be wetted to cool the body.

Therefore, it can be appreciated that there exists a continuing need for new and improved thermos bottle liner system which can be used for maintaining a Thermos bottle cool while providing the user with a towel that can be wetted to cool the body. In this regard, the present invention substantially fulfills this need.

SUMMARY OF THE INVENTION

In view of the foregoing disadvantages inherent in the known types of Thermos bottles and wraps therefore now present in the prior art, the present invention provides an improved Thermos bottle liner system. As such, the general purpose of the present invention, which will be described subsequently in greater detail, is to provide a new and improved Thermos bottle liner system and method which has all the advantages of the prior art and none of the disadvantages.

To attain this, the present invention essentially comprises a new and improved Thermos bottle liner system for maintaining a Thermos bottle cool and also for providing the user with a towel that can be wetted to cool the body comprising thermally insulated Thermos bottle having a cylindrical side wall with a closed bottom wall and with an opened top, the bottle also including a lid with an opening for pouring the contents of the bottle therefrom and an associated inverted "U" shaped handle with free ends coupled to an upper extent of the bottle for transportation purposes.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved Thermos bottle liner system which have all the advantages of the prior art Thermos bottles and wraps and none of the disadvantages.

It is another object of the present invention to provide new and a improved Thermos bottle liner system which may be easily and efficiently manufactured and marketed.

It is further object of the present invention to provide a new and improved Thermos bottle liner system which are of durable and reliable constructions.

An even further object of the present invention is to provide a new and improved Thermos bottle liner system which are susceptible of a low cost of manufacture with regard to both materials and labor, and which accordingly are then susceptible of low prices of sale to the consuming public, thereby making such Thermos bottle liner system economically available to the buying public.

Still yet another object of the present invention is to provide a new and improved Thermos bottle liner system which provide in the apparatuses and methods of the prior art some of the advantages thereof, while simultaneously overcoming some of the disadvantages normally associated therewith.

Even still another object of the present invention is to maintaining a Thermos bottle cool while providing the user with a towel that can be wetted to cool the body.

Lastly, it is an object of the present invention to provide a new and improved 2. Thermos bottle liner comprising:

a liner in a generally rectangular configuration and positionable in a cylindrical configuration around the side wall of the bottle, the liner including in a rectangular configuration with long upper and lower edges and short parallel side edges, an interior layer of a pile type fabric, preferably terry cloth, the liner also including an exterior layer fabricated of a flexible plastic in a rectangular configuration with long upper and lower edges and short parallel side edges, the interior layer and exterior layer being off set laterally with respect to each other forming an outwardly exteriorly facing rectangular coupling area on the exterior face of the interior layer with a pile type fastener thereon and forming an inwardly facing rectangular area on the interior face of the exterior layer with a pile type fastener.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the new and improved Thermos bottle liner system constructed in accordance with the principles of the present invention.

FIG. 2 is an enlarged view taken at circle to a FIG. 1 but with the liner partially removed.

The same reference numerals refer to the same parts through the various Figures.

DESCRIPTION OF THE PREFERRED EMBODIMENT

Figure 3:
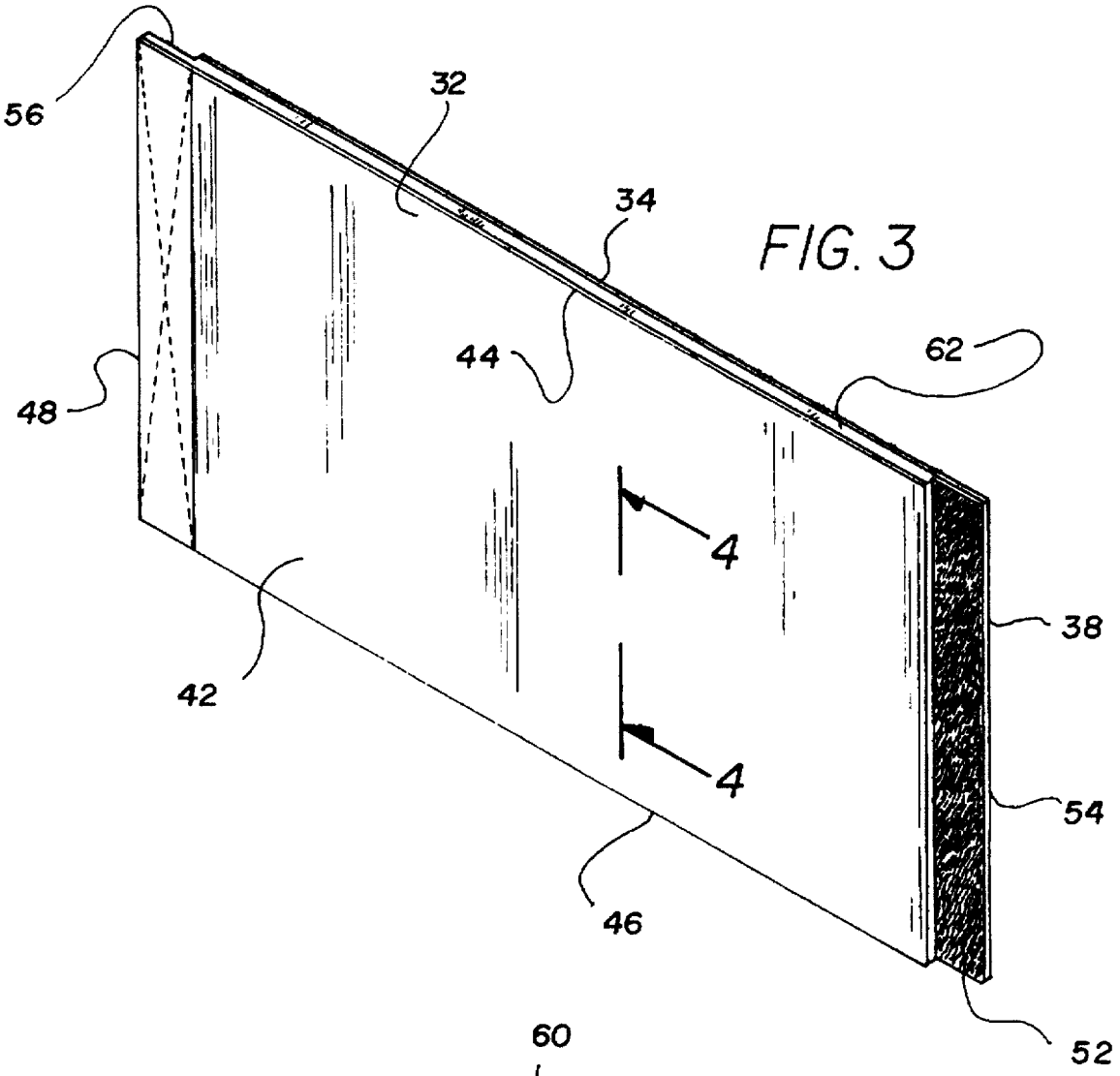
FIG. 3 is a perspective view of the liner shown in FIGS. 1 and 2.
Figure 4:
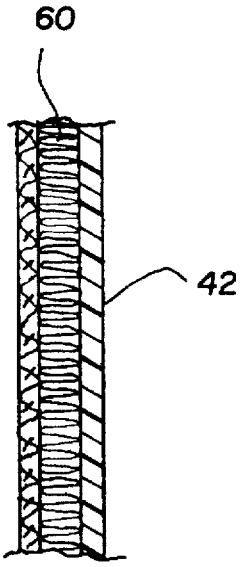
FIG. 4 is a cross sectional view taken along line 44, of FIG. 3.

With reference now to the drawings, and in particular to FIG. 1 thereof, the preferred embodiment of the new and improved Thermos bottle liner system embodying the principles and concepts of the present invention and generally designated by the reference numeral 10 will be described.

The present invention, the new and improved Thermos bottle cover system is comprised of a plurality of components. Such components in their broadest context include bottle, lid, removable cover, cover, handle and fasteners. Such components are individually configured and correlated with respect to each other so as to attain the desired objective.

The present invention is a system 10. A primary component of such system is a thermal bottle 12. The thermal bottle is formed to have a cylindrical side wall 14. It also has a closed bottom wall 16 with an opened 18. The bottle also includes a lid 20. The lid is formed with an opening 22 with a removable cover 24 for pouring the contents of the bottle therefrom. Intermating male threads at the upper extent of the bottle cooperate with matting female threads on an interior surface of the bottom extent of the lid. In addition, an associated inverted "U" shaped handle 26 is provided. Such handle has free ends 28 coupled to an upper extent of the bottle for transportation purposes.

Next provided as a component of the system 10 is a cover 32. The cover is in a generally rectangular configuration. It is positionable in a cylindrical configuration around the side wall of the bottle. The cover includes an interior layer. The interior layer is formed of a pile type fabric, preferably terry cloth. The interior layer is in a rectangular configuration with long upper and lower edges 34 36 and short parallel side edges 38.

The cover also includes an exterior layer 42. Such exterior layer is fabricated of a flexible plastic such as polyethylene. It is in a rectangular configuration with long parallel upper and lower edges 44 46. It also has short parallel side edges 48 therebetween.

The interior layer and the exterior layer are off set laterally with respect to each other. In this manner, such layers form an outwardly facing rectangular coupling strip area 52 on the exterior face of the interior layer. A pile type fastener 54 is stitched thereon. Such off set of the layers also forms an inwardly facing rectangular area 56. Such area is on the interior face of the exterior layer. A pile type fastener 56 is stitched thereon.

The cover also includes an insulating layer 60. Such insulating liner is intermediate the interior and exterior layers. The insulating layer is formed of a rectangular configuration with long parallel upper and lower edges 62 64 and with short parallel side edges therebetween. The insulating layer is of a size equal to the region of overlap between the inner and outer layers.

The insulating layer is formed of a conventional foam insulating material used for insulating a wide variety of products and is well defined in the patent and other literature.

The cover is adapted to be wrapped around the side wall of the thermal bottle. In this manner, the pile type fasteners of the inner and outer layers are releaseably coupled with respect to each other. The ares of the insulating layer is not essentially equal to the area of the side wall of the thermal bottle.

The present invention is a terry cloth thermal bottle insulator that functions to keep the bottle cool and also provides the user with a towel that can be wetted to cool the body. The present invention is a sheet of cloth-lined material that can be formed into a cylindrical shape to fit almost any size thermal bottle. A Velcro strip provides the means for securing the material to the outside of the container, the sheet is constructed from a plastic exterior shell, an insulating interior, and a terry cloth liner. Being able to absorb a considerable amount of water, the liner can be used to apply cool water to the body. In use, the invention is simply secured around the bottles and is stored along with it. It serves two purposes: to keep the contents of a bottle cooler, and to provide a towel which can be used for cooling the body. It can be sized to suit almost any application and should prove quite convenient in warmer climates, anyone who uses a thermos bottle should appreciate it advantages.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved thermal bottle insulation system for maintaining a thermal bottle cool and also for providing the user with a towel that can be wetted to cool the body comprising, in combination:

a thermally insulated bottle having a cylindrical side wall with a closed bottom wall and with an opened top, the bottle also including a lid with an opening for pouring the contents of the bottle therefrom and an associated inverted "U" shaped handle with free ends coupled to an upper extent of the bottle for transportation purposes;

a cover in a generally rectangular configuration and positionable in a cylindrical configuration around the side wall of the bottle, the cover including long upper and lower edges and short parallel side edges, and an interior layer of a terry cloth material, the cover also including an exterior layer fabricated of a flexible plastic in a rectangular configuration with long upper and lower edges and short parallel side edges, the interior layer and exterior layer being off set laterally with respect to each other forming an outwardly exteriorly facing rectangular coupling area on the exterior face of the interior layer with a pile type fastener thereon and forming an inwardly facing rectangular area on the interior face of the exterior layer with a pile type fastener thereon; and an insulating layer intermediate the interior and exterior layers, the insulating layer being of a rectangular configuration with long parallel upper and lower edges and short parallel side edges of a size equal to the region of overlap between the inner and outer layers, the cover adapted to be wrapped around the side wall of the bottle with the pile type fasteners of the inner and outer layers releasably coupled with respect to each other.

* * * * *